US009783208B2

(12) United States Patent
Herden et al.

(10) Patent No.: US 9,783,208 B2
(45) Date of Patent: Oct. 10, 2017

(54) METHOD AND DEVICE FOR ANALYZING A SCATTERING MATERIAL AND FOR CONTROLLING THE APPLICATION OF A SCATTERING MATERIAL TO A RAIL FOR A RAIL VEHICLE

(71) Applicant: KNORR-BREMSE SYSTEME FÜR SCHIENENFAHRZEUGE GMBH, Munich (DE)

(72) Inventors: Marc-Oliver Herden, Munich (DE); Thomas Rasel, Höhenkirchen-Siegertsbrunn (DE)

(73) Assignee: KNORR-BREMSE SYSTEME FÜR SCHIENENFAHRZEUGE GMBH (DE)

( * ) Notice: Subject to any disclaimer, the term of this patent is extended or adjusted under 35 U.S.C. 154(b) by 245 days.

(21) Appl. No.: 14/760,173

(22) PCT Filed: Dec. 27, 2013

(86) PCT No.: PCT/EP2013/078033

§ 371 (c)(1),
(2) Date: Jul. 9, 2015

(87) PCT Pub. No.: WO2014/108316

PCT Pub. Date: Jul. 17, 2014

(65) Prior Publication Data

US 2015/0353101 A1 Dec. 10, 2015

(30) Foreign Application Priority Data

Jan. 11, 2013 (DE) ..... 10 2013 100 250

(51) Int. Cl.
*B61C 15/10* (2006.01)

(52) U.S. Cl.
CPC ..... *B61C 15/10* (2013.01)

(58) Field of Classification Search
CPC ..... B61C 15/10; B61C 15/107; B61C 15/08; B60B 39/10; B60B 39/025; B60B 3/106
See application file for complete search history.

(56) References Cited

U.S. PATENT DOCUMENTS 5,723,768 A * 3/1998 Ammon ..... B60C 23/061 180/271
2004/0060375 A1 4/2004 Kumar et al.
(Continued)

FOREIGN PATENT DOCUMENTS

CN 100478192 C 2/2005
CN 103781636 A 5/2014
(Continued)

OTHER PUBLICATIONS

DE 10 2005 001 404, Jul. 2006 (English translation of the description portion).*
(Continued)

*Primary Examiner* — Mark Le
(74) *Attorney, Agent, or Firm* — Barnes & Thornburg LLP

(57) ABSTRACT

A method for analyzing a scattering material located at a contact point between a rail and a wheel of a rail vehicle wherein the scattering material improves the force closure between the rail and the wheel. The method reads in a motion signal that represents a motion of the wheel caused by the scattering material located on the rail and evaluates the motion signal to analyze the scattering material located on the rail.

8 Claims, 2 Drawing Sheets

(56) References Cited

U.S. PATENT DOCUMENTS

| | | | |
|---|---|---|---|
| 2004/0075280 | A1 | 4/2004 | Kumar et al. |
| 2005/0140144 | A1 | 6/2005 | Kumar |
| 2005/0253397 | A1 | 11/2005 | Kumar et al. |

FOREIGN PATENT DOCUMENTS

| | | | |
|---|---|---|---|
| DE | 4122032 | A1 | 8/1992 |
| DE | 102005001404 | A1 | 7/2006 |
| DE | 102009041823 | A1 | 3/2011 |
| DE | 102011113071 | A1 | 3/2013 |
| EP | 0 217 636 | A2 | 4/1987 |
| EP | 1 181 179 | A1 | 2/2002 |

OTHER PUBLICATIONS

Chinese Office Action for Chinese Appiication No. 201380070059.1, dated Aug. 2, 2016, along with English translation.

Search Report for German Patent Application No. 10 2013 100 250.1; Jan. 20, 2014.

Search Report for International Patent Application No. PCT/EP2013/078033; Mar. 31, 2014.

* cited by examiner

METHOD AND DEVICE FOR ANALYZING A SCATTERING MATERIAL AND FOR CONTROLLING THE APPLICATION OF A SCATTERING MATERIAL TO A RAIL FOR A RAIL VEHICLE

PRIORITY CLAIM

This patent application is a U.S. National Phase of International Patent Application No. PCT/EP2013/078033, filed 27 Dec. 2013, which claims priority to German Patent Application No. 10 2013 100 250.1, filed 11 Jan. 2013, the disclosures of which are incorporated herein by reference in their entirety.

FIELD

Disclosed embodiments relate to a method for analyzing a scattering material located at a contact point between a rail and a wheel of a rail vehicle, to a method for controlling the application of a scattering material to a rail for a rail vehicle, to corresponding devices, and also to a scattering system for applying a scattering material to a rail for a rail vehicle.

Disclosed embodiments provide a method for analyzing a scattering material located at a contact point between a rail and a wheel of a rail vehicle, an improved method for controlling the application of a scattering material to a rail for a rail vehicle, corresponding devices, and also an improved scattering system for applying a scattering material to a rail for a rail vehicle.

BRIEF DESCRIPTION OF THE FIGURES

Disclosed embodiments will be explained in greater detail hereinafter with reference to the accompanying drawings, in which.

DETAILED DESCRIPTION OF THE DISCLOSED EMBODIMENTS

Figure 1:
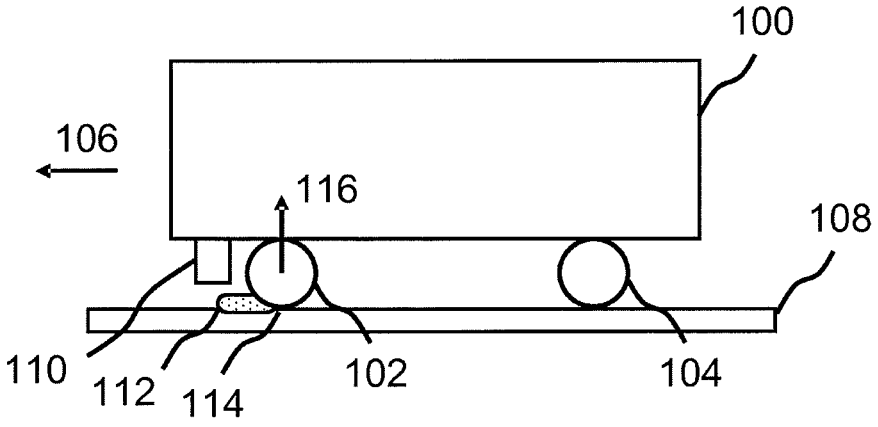
FIG. 1 shows a schematic illustration of a rail vehicle in accordance with an exemplary embodiment.

Sanding systems in rail vehicles apply a scattering material to the rail, for example sand. The scattering material improves the frictional connection between wheel and rail at the contact point between wheel and rail during the driving and braking procedures of the rail vehicle. This effect of improving the frictional connection occurs in particular when the frictional connection is reduced due to dirtied, moist rails and a transfer of force is thus hindered.

Put simply, the scattering material cleans the rail, bridges a possible separation layer between wheel and rail, and therefore makes a higher flow of forces possible. For this purpose the scattering material is usually always scattered precisely at or ahead of the striking point, i.e. the contact point between the wheel and the rail. By means of an analysis of the scattering material located at the contact point, it is possible for example to see whether or not the scattering material is actually effective. A scattering material applied to the rail for example may not have any effect or may only have a small effect when the scattering material is blown away or the separation layer between rail and wheel is too thick. The analysis of the scattering material located at the contact point in this sense makes it possible for example to draw a conclusion as to whether a scattering material scattered onto the rail to improve the frictional connection between the rail and the wheel also reaches the relevant contact point between rail and wheel and can also take effect there.

A method for analyzing a scattering material located at a contact point between a rail and a wheel of a rail vehicle for improving the frictional connection between the rail and the wheel comprises the following steps: reading in a movement signal representing a movement of the wheel caused by the scattering material located on the rail; and evaluating the movement signal to analyze the scattering material located on the rail.

A rail vehicle can be understood to mean a vehicle of a wheel/rail system, the vehicle travelling or being guided by means of at least one wheel on one or more rails. By way of example, the vehicle may be a railway vehicle. The rail vehicle may be motorized or un-motorized, i.e. for example may be a railcar or a carriage. The rail vehicle can be intended for example for passenger transport or for the transport of goods. The wheel may be a bogie wheel of the rail vehicle. The rail vehicle may have a plurality of such wheels. By way of example, two wheels can be interconnected via a common axle. The contact point can be perceived as a bearing surface, within which the wheel rests on the rail. Both the wheel and the rail can be manufactured from metal, for example from steel. The scattering material may be a suitable scattering material, for example sand, as is already used with rail vehicles to improve the frictional connection between wheel and rail. The scattering material may be composed of a quantity of particles, for example grains of sand. The frictional connection and therefore the friction between the wheel and rail can be increased by particles of the scattering material that at the contact point are in contact simultaneously with the wheel and the rail. A surface of the rail facing toward the wheel is smooth per se. The scattering material located on the surface of the rail leads to an unevenness on the surface of the rail. When the wheel rolls over such an unevenness, the unevenness may lead to movements, for example to vibrations or longitudinal movements of the wheel, in particular to vertical movements of the wheel. Such a movement of the wheel caused by the scattering material may be dependent on different properties of the scattering material located at the contact point. One property for example may concern a quantity or density of the scattering material located on the rail at the contact point. A further property for example may concern the nature, for example the hardness or size, of the particles of the scattering material. A further property for example may concern an embedding of the scattering material in a separation layer possibly located on the surface of the rail, which separation layer for example may be composed of foliage residues. Different properties of the scattering material can be characterized by characteristic courses of the movement of the wheel. A property of the scattering material at the contact point can thus be determined from a characteristic course of the movement of the wheel. The scattering material can thus be analyzed via an evaluation of the movement of the wheel.

The properties of the scattering material determined by the analysis of the scattering material can in turn be assigned different effects of the scattering material, which for example affect a braking process of the rail vehicle. The movement of the wheel can be detected via a suitable detection unit, for example an acceleration sensor, a strain gauge, a solid-borne sound sensor or via another suitable sensing element. The movement signal may represent a signal provided by the sensing unit or a processing unit arranged downstream of the sensing unit. The movement signal may be an analogue or digital electrical signal. The movement signal can be evaluated using suitable known evaluation methods to first analyze the movement signal and on this basis then analyze the scattering material located on the rail. By way of example, an evaluation of the movement signal can be based on a comparison of the movement signal with one or more references, for example a reference value or a reference signal. Corresponding references may relate to different properties to be analyzed of the scattering material located at the contact point, and for example may have been determined previously during a test run of a rail vehicle.

A sensing unit for sensing the movement of the wheel may be arranged for example on the wheel itself, on a wheel hub of the wheel or on an axle carrying the wheel. Depending on the arrangement of the sensing unit, the movement signal may represent the movement of the wheel per se in isolation or a superimposition of the movements of a number of wheels, for example of two wheels of the rail vehicle.

In accordance with at least one disclosed embodiment the movement signal may represent a course over time of the movement of the wheel. A course of the movement of the wheel over time can thus be portrayed. Such a movement signal can be read in via an interface to a sensing unit. Such a movement signal can be provided very quickly and easily.

In accordance with a further disclosed embodiment the movement signal may represent a signal determined from the course over time of the movement of the wheel. The movement signal in this case may already be pre-processed. By way of example, the movement signal may be a transformed signal. By way of example, a Fourier transformation can be performed to obtain the movement signal. The movement signal may portray the movement of the wheel for example in the frequency domain. Such a pre-processed movement signal may facilitate the evaluation.

By way of example, a frequency spectrum of the movement signal can be evaluated in the evaluation step to analyze the scattering material located on the rail. By way of example, a course characteristic for a typical property of a scattering means can be determined in a frequency spectrum of the movement of the wheel by calculations or series of tests. In the evaluation step the frequency spectrum of the movement signal or a frequency range of the frequency spectrum of the movement signal can then be compared with the characteristic course to analyze the property of the scattering material. Accordingly, characteristic courses for each of a plurality of typical properties of the scattering material can be determined in the frequency spectrum and used for analysis of the movement signal.

A method in which, in the evaluation step, profiles of a plurality of successive deflections in a course of the movement signal are evaluated to analyze the scattering material located on the rail. A deflection may constitute what is known as a peak in the course of the movement signal. For evaluation, corresponding characteristic values with regard to the profile of the deflections, such as the height or length thereof, can be placed in relation to predetermined reference values or reference intervals. By way of example, a height of the deflections can be evaluated in each case. Additionally or alternatively, a length of the deflections can be evaluated in each case. Accordingly, mean values formed over the plurality of deflections can be evaluated. The movement signal can be evaluated in this way by simple threshold value comparisons.

By way of example, a density of the scattering material at the contact point can be determined in the evaluation step with use of the movement signal to analyze the scattering material. The density can be understood to be a number of particles of the scattering material per unit of area. Information regarding the density can be used advantageously to readjust an application of the scattering material. If an excessively low density is determined, the quantity of scattering material to be applied can be increased, for example.

Additionally or alternatively, an embedding of the scattering material into a foreign layer located on the surface of the rail can be determined in the evaluation step with use of the movement signal to analyze the scattering material. Depending on the layer thickness and consistency of the foreign layer, particles of the scattering material can become embedded fully or partially in the foreign layer. If an excessive embedding of the scattering material in a foreign layer is determined, the quantity of scattering material to be applied can be increased to build up the layer thickness of the foreign layer with scattering material.

A method for controlling the application of a scattering material to a rail for a rail vehicle comprises the following steps: performing the steps of an analyzing method to obtain an analysis result with regard to a scattering material located at a contact point between the rail and a wheel of the rail vehicle; adapting an application instruction for applying the scattering material to the rail with use of the analysis result; and providing a control signal to apply the scattering material to the rail in accordance with the application instruction.

By way of example, the application instruction may define the quantity of scattering material to be applied to the rail and additionally or alternatively the position at which the scattering material is applied relative to the contact point. If the analysis result for example indicates an insufficient quantity of the scattering material at the contact point, the quantity of scattering material to be applied can thus be increased, or the direction or position of the application of the scattering material can be varied. If the analysis result by contrast indicates an excessive quantity of scattering material at the contact point, the quantity of scattering material can be reduced. The control signal may be an electrical signal, for example. The control signal can be configured to control a control unit for applying the scattering material to the rail. By adapting the application instruction, a control circuit can be created, by means of which the application of the scattering material and therefore also the effect of the scattering material can be optimized.

A device for analyzing a scattering material located at a contact point between a rail and a wheel of a rail vehicle has units that are configured to carry out the steps of a specified method for analyzing a scattering material located at a contact point between a rail and a wheel of a rail vehicle. A device for controlling the application of a scattering material to a rail for a rail vehicle accordingly has units that are configured to perform the steps of a specified method for controlling the application of a scattering material to a rail for a rail vehicle. A device can be understood in the present case to mean an electrical apparatus, which processes the movement signal and outputs control and/or data signals as a function thereof. The device may have an interface, which can be a hardware and/or software interface. In the case of a hardware design the interfaces for example may be part of an integrated circuit, which contains a wide range of functions of the device. In the case of a software design the interfaces may be software modules, which for example are provided on a microcontroller besides other software modules.

A scattering system for applying a scattering material to a rail for a rail vehicle has the following features: a scattering unit for applying the scattering material to the rail; and a device for analyzing a scattering material located at a contact point between a rail and a wheel of a rail vehicle or a device for controlling the application of a scattering material to a rail for a rail vehicle.

The scattering unit for example may be provided as a sander. The scattering system may be part of the rail vehicle or may be intended for assembly on the rail vehicle. The rail vehicle may have a plurality of scattering systems. By means of operation the scattering system, scattering material can be applied to the rail during the journey of the rail vehicle, for example to increase the friction between wheel and rail during a braking process of the rail vehicle.

What is also advantageous is a computer program product with program code, which can be stored on a machine-readable support, such as a semiconductor memory, a hard disk memory or an optical memory, and is used to carry out the method according to one of the above-described embodiments when the program product is executed on a computer or a suitable device.

Like or similar reference signs will be used in the following description of exemplary embodiments for similarly acting elements illustrated in the various figures, thus eliminating the need for a repeated description of these elements.

FIG. 1 shows a schematic illustration of a rail vehicle 100 in accordance with an exemplary embodiment. The rail vehicle 100 by way of example has a first wheel 102 and a second wheel 104, which are guided, during a journey of the rail vehicle 100, on a rail 108 in a direction of travel 106. The rail vehicle 100 has at least one scattering system 110 for applying a scattering material 112 to the rail 108. The shown scattering system 110 is arranged on the rail vehicle 100 such that the scattering material 112 is applied to a surface of the rail 108 facing toward the rail vehicle 112 ahead of a contact point 114 between the first wheel 102 and the rail 108 with respect to the direction of travel 106. When the first wheel 102 rolls over the scattering material 112, the first wheel 102 is deflected by the scattering material 112 and performs a corresponding movement 116, here a vertical movement 116 directed away from the rail 108.

A movement profile of the movement 116 is dependent on a property of the scattering material 112 located at the contact point 114. By way of example, the movement profile of the movement 116 is dependent on a quantity of the scattering material 112 located at the contact point 114 and on an embedding of the scattering material 112 in a foreign layer possibly located on the rail 108, which foreign layer for example may be produced by foliage located on the rail 108.

The movement 116 can be detected by a suitable detection unit. The detection unit for this purpose can be coupled, for example directly, to the first wheel 102, to a wheel axle of the first wheel 102, to a wheel hub of the first wheel 102, to a wheel suspension of the first wheel 102, to a bogie comprising the first wheel 102, or to another suitable component of the rail vehicle 100, and may be configured to sense the movement 116 and to output a movement signal representing the movement 116 or the movement profile of the movement 116. The movement signal can be evaluated with the use of a suitable evaluation unit to be able to draw a conclusion with regard to the scattering material 112 causing the movement 116. In this way the scattering material 112 can be analyzed via the movement 116. An analysis result with regard to the scattering material 112 can be used for example to control the scattering system 110 or to control a braking maneuver or stopping maneuver of the rail vehicle 100.

Figure 2:
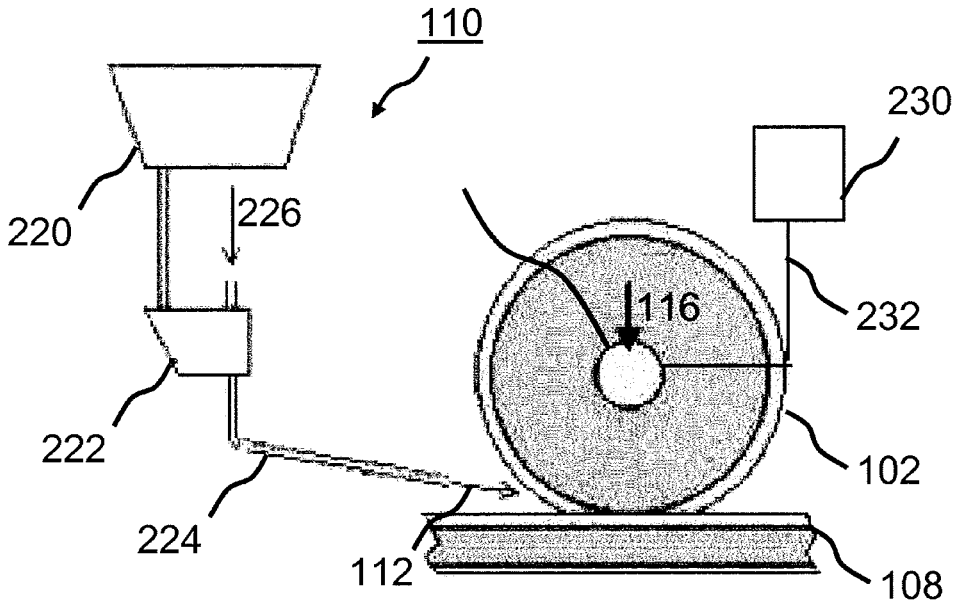
FIG. 2 shows a schematic illustration of a scattering system in accordance with an exemplary embodiment.

FIG. 2 shows a schematic illustration of a scattering system 110 in accordance with an exemplary embodiment. The scattering system 110 can be used for example in conjunction with the rail vehicle described with reference to FIG. 1. The scattering system 110 is configured to apply a scattering material 112 to a contact point between a rail 108 and a wheel 102 running on the rail 108. The wheel 102 has a wheel axle 218. The wheel 102 and the wheel axle 218 perform a movement 116 on account of the wheel 102 rolling over the scattering material 112. FIG. 2 shows the movement 116 as a rearward movement of the wheel 102 in the direction of the rail 108.

The scattering system 110 has a storage container 220 for scattering material 112, for example a sandpit, a sand valve 222, and a sand nozzle 224. The storage container 220 is configured to hold scattering material 112 and to dispense it to the sand valve 222. The sand valve 222 has an opening for feeding compressed air 226. If compressed air 226 is fed to the sand valve 222, scattering material 112 is thus guided from the storage container 220 through the sand valve 222 to the sand nozzle 224 and is blown from an outlet opening of a discharge pipe of the sand nozzle 224 in the direction of the contact point between the rail 108 and the wheel 102.

The dispensing of the scattering material 112 can be controlled for example via a controller of the compressed air 226 or via an orientation of the outlet opening of the sand nozzle 224. By way of example, a valve for providing the compressed air can be actuated via a suitable control signal, and the dispensing of the scattering material 112 can thus be controlled. Furthermore, a servomotor can be driven via a suitable control signal to control the orientation of the outlet opening of the sand nozzle 224 and thus the dispensing of the scattering material 112. In accordance with an exemplary embodiment at least one control signal for controlling the dispensing of the scattering material 112 is generated depending on a property of the scattering material 112 at the contact point between the wheel 102 on the rail 108, the property being determined via the movement 116 of the wheel 102.

The movement 116 of the wheel 102 can be sensed by means of a suitable sensing unit and can be evaluated by a device 230 for analyzing the scattering material 112 located at the contact point between the rail 108 and the wheel 102. For this purpose, the sensing unit is configured to provide a movement signal 232 representing the movement 116 to the analyzing device 230, for example via an electrical line. The device 230 for analyzing can be embodied in an electronics unit or electrical circuit.

Exemplary embodiments of an effective monitoring for a scattering system 110 of a rail vehicle will be described hereinafter. Sand will be assumed hereinafter to be the scattering material 112, and therefore a scattering system 110 which may be a sanding system is assumed.

The effect of the sanding as a result of the sand 112 being rolled over and therefore the grain being broken is measured indirectly by the effect on the rolling behavior of the wheel 102. A sensing unit, for example a vibration sensor on the respective wheel bearing, is used for this purpose and provides information regarding the vertical acceleration 116.

The movement signal provided by the sensing device, i.e. the measurement signal, is evaluated by the analyzing device 230, which can be provided as an electronics unit. The evaluation can be performed for example by one or more Fourier analyses, such that a specific change of the frequency spectrum resulting from the sand 212 being rolled over is monitored. The length and height of the deflections can be used to identify how much sand 212 actually comes into contact with the wheel and how damped or "clear" is the frictional connection. This can be used for a diagnosis, an effective monitoring, and for a possible quantity or position regulation of the sanding. By way of example, such a monitoring can be integrated as a standard function into a bogie diagnosis of a rail vehicle. The approach can also be used to obtain feedback as regard to whether sand 212 is actually flowing from the sanding system 110. This can be performed additionally to or instead of a sand flow sensor, which can determine the flow rate to a certain degree. By means of the evaluation of the movement signal 212, it is advantageously also possible to detect whether the sand 212 is effective or reaches the wheel/rail contact point.

Figure 3:
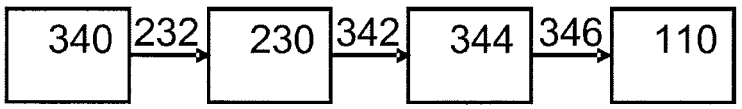
FIG. 3 shows a schematic illustration of an analyzing device in accordance with an exemplary embodiment.

FIG. 3 shows a schematic illustration of a device 230 for analyzing a scattering material located at a contact point between a rail and a wheel of a rail vehicle, which device is used in accordance with this exemplary embodiment in a control circuit for controlling a scattering system 110 for applying the scattering material to the rail. The device 230 and the scattering system 110 can be used for example in conjunction with the rail vehicle shown in FIG. 1.

What is shown is a sensing unit 340, which is configured to sense a movement of the wheel of the rail vehicle characteristic for a scattering material located on the rail and to generate a movement signal 232 representing the movement and to output this signal to the analyzing device 230. The analyzing device 230 is configured to evaluate the movement signal 232 and to output an analysis result 342 corresponding to the evaluation to a control unit 344. The control unit 344 is configured to generate a control signal 346 with use of the analysis result 342 and to output this control signal to the scattering system 110 to control the scattering system.

The sensing unit 340 is configured to sense a movement of the wheel of the rail vehicle and to generate and to output the movement signal 232 representing the movement. The sensing unit 340 can be configured to sense a vertical movement of the wheel or a component of a vertical movement of the wheel. The sensing unit 340 can be embodied for example as an acceleration sensor. In this case the sensing unit 340 can be configured to sense an acceleration of the wheel as the movement of the wheel.

The analyzing device 230 is configured to read in and to evaluate the movement signal 232. Here, the analyzing device 230 can be configured to evaluate a course over time of the movement signal 232. Alternatively or additionally, the analyzing device 230 can be configured to evaluate a frequency spectrum or a frequency range of a frequency spectrum of the movement signal. For this purpose the device 230 for analyzing can be configured to transform the read-in movement signal into the frequency domain. Alternatively, the device 230 for analyzing may also be configured to receive the movement signal 232 as a signal already transformed into the frequency domain. A corresponding transformation may have been carried out in this case by the sensing unit 340 or an intermediate processing unit. The analyzing device 230 is configured to evaluate a course or a characteristic of the movement signal 232 to analyze the scattering material. Known methods for signal evaluation of a signal present in the time domain or frequency domain can be used for this purpose. By way of example, the movement signal 232 can be classified by the evaluation, wherein different class divisions of the movement signal 232 can in turn be associated with different properties of the scattering material. By way of example, the evaluation can be based on comparisons with predetermined signal values or signal courses characteristic for certain properties of the scattering material. By way of example, such signal values or signal courses may have been determined during practical test runs. Such predetermined signal values or signal courses can be stored in a memory unit and read out by the analyzing device 230 to evaluate the movement signal 232.

The analyzing device 230 is configured to output an analysis result 342 corresponding to the evaluation to a control unit 344. The analysis result 342 comprises information regarding the property, determined on the basis of the movement signal 232, of the scattering material at the contact point between the wheel and the rail.

The control unit 344 is configured to receive the analysis result 342 and on this basis to generate a control signal 346 for controlling or regulating the scattering system 110 and to provide this control signal at an interface to the scattering system 110. The control unit 344 is configured for this purpose, with use of the analysis result 342, to adapt an application instruction for applying the scattering material to the rail and to generate the control signal 346 based on the adapted application instruction. By way of example, the application instruction can define how much and in what way the scattering material is to be dispensed.

A control circuit can thus be provided, in which scattering material is first applied by the scattering system 110, then an effect of the scattering material at the contact point is analyzed, and on this basis the application of further scattering material by the scattering system 110 is readjusted or maintained without change.

Alternatively or additionally, the analysis result 344 can be provided to a further control unit or monitoring unit, for example to control an acceleration process or a braking process of the rail vehicle, to monitor a function of the scattering system 110, or to obtain knowledge regarding a surface state of the rail.

Figure 4:
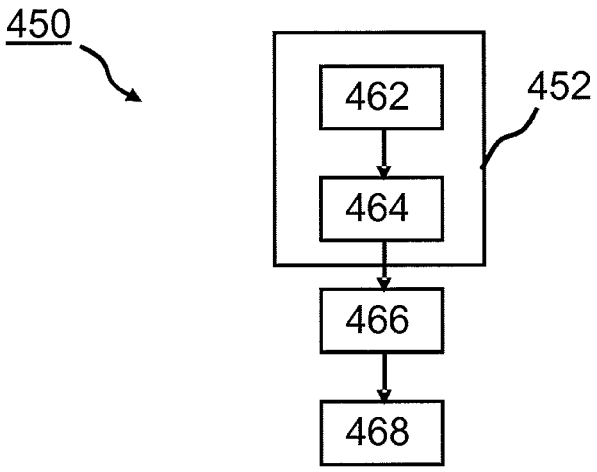
FIG. 4 shows a flow diagram of a method for controlling the application of a scattering material in accordance with an exemplary embodiment.

FIG. 4 shows a flow diagram of a method 450 for controlling an application of a scattering material to a rail for a rail vehicle in accordance with an exemplary embodiment. The method 450 in accordance with this exemplary embodiment comprises a method 452 for analyzing a scattering material located at a contact point between the rail and a wheel of the rail vehicle. The control method 450 can be performed for example to control the scattering system of the rail vehicle shown in FIG. 1. The movement signal 232 can be evaluated for example by a device for analyzing, as described with reference to FIG. 3.

The analyzing method 452 comprises a step 462 of reading in a movement signal representative of a movement of the wheel caused by the scattering material located on the rail and a step 464 of evaluating the movement signal to analyze the scattering material located on the rail.

Besides the steps 462, 464 of the analyzing method 452, the control method 450 comprises a step 466 of adapting an application instruction for applying the scattering material to the rail with the use of an analysis result determined in step 464 of the evaluation. Lastly, in a step 468, a control signal is provided to apply the scattering material to the rail in accordance with the application instruction. For this purpose the control signal can be provided to a suitable unit of the scattering system, for example a unit for controlling the compressed air used for the application of the scattering material.

Alternatively, the analyzing method 452 can also be performed autonomously, i.e. independently of the further steps 466, 468 of the control method 450.

Figure 5:
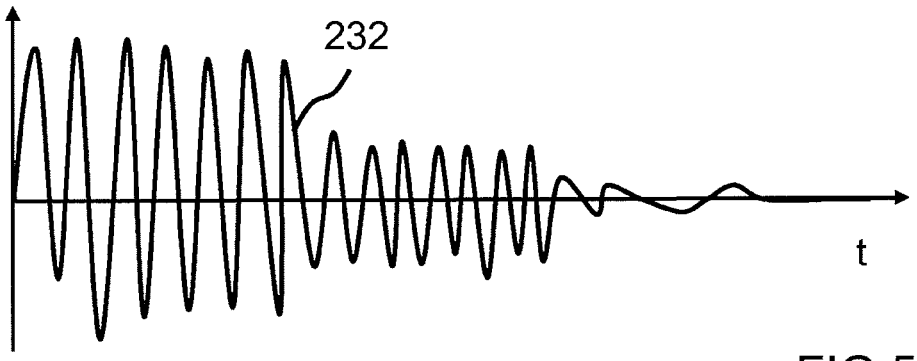
FIG. 5 shows the course of a movement signal in the time domain in accordance with an exemplary embodiment.

FIG. 5 shows a schematic course of a movement signal 232 in the time domain in accordance with an exemplary embodiment. The movement signal 232 may be a signal representative of a movement, caused by a scattering material located on a rail, of a wheel of a rail vehicle as described by way of example with reference to FIG. 1. The movement signal 232 can be evaluated for example by an analyzing device, as described with reference to FIG. 3. The movement signal 232 is illustrated in a coordinate system. Here, the time t is illustrated on the abscissa and the amplitude of the movement signal 232 is illustrated on the ordinate. By way of example, the movement signal 232 can portray an acceleration, a speed or a deflection of a wheel. The movement signal 232 can be filtered or unfiltered. By way of example, irrelevant frequency components of the movement signal 232 may have been filtered out for the analysis of the scattering material so as to be able to evaluate the movement signal 232 more easily. A current speed of the rail vehicle can be included in the evaluation of the movement signal.

In a first time portion the movement signal 232 has a plurality of deflections, which assimilate one another in terms of their respective height, i.e. their amplitude, and their length, i.e. their duration. A property of the scattering material can be determined on the basis of the height and additionally or alternatively on the basis of the length of the deflections. For this purpose one of the plurality of deflections in the first time portion can be evaluated, or an average deflection determined from the plurality of deflections can be evaluated, for example by forming an average.

In a second time portion following the first time portion the movement signal 232 has a further plurality of deflections, which again assimilate one another, but differ in their average amplitude from the plurality of deflections in the first time portion.

In a third time the portion following the second time portion the movement signal 232 does not have any deflections or has only very few deflections.

The course of the movement signal 232 in the first time portion may be characteristic for a first property of the scattering material, the course of the movement signal 232 in the second time portion may be characteristic for a second property of the scattering material, and the course of the movement signal 232 in the third time portion may be characteristic for a third property of the scattering of material. By way of example, the course of the movement signal 232 in the first time portion may be associated with a scattering material that enables a direct frictional connection between rail and wheel. The course of the movement signal 232 in the second time portion may be associated for example with a scattering material that is incorporated in a foreign layer, whereby the frictional connection between the rail and the wheel is damped. The course of the movement signal 232 in the third time portion may be associated for example with a scattering material that either is insufficient for building up a foreign layer located on the rail or that has not reached the contact point between the wheel and the rail, for example because it was blown from the rail.

Figure 6:
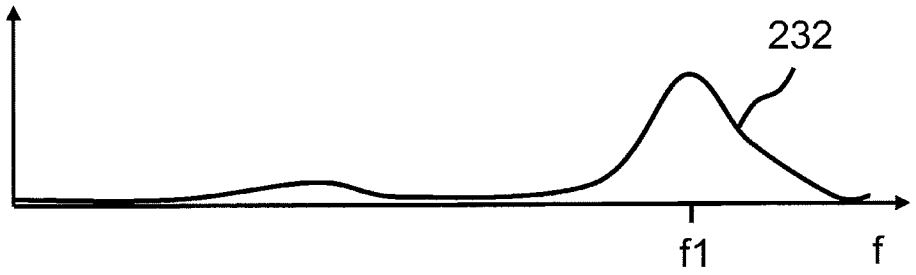
FIG. 6 shows the course of a movement signal in the frequency domain in accordance with an exemplary embodiment.

FIG. 6 shows a course of a movement signal 232 in the frequency domain in accordance with an exemplary embodiment. The movement signal 232 may be a signal representative of a movement, caused by a scattering material located on a rail, of a wheel of a rail vehicle as described by way of example with reference to FIG. 1. The movement signal 232 is illustrated in a coordinate system. Here, the frequency f is illustrated on the abscissa. By way of example, maximum values of the movement signal 232 or values of the movement signal 232 in certain frequency ranges can be evaluated with an evaluation of the movement signal 232 to analyze the scattering material. By way of example, the movement signal 232 has a maximum at a frequency f1. With the evaluation of the movement signal 232, it is possible to conclude for example, on the basis of the maximum of the frequency f1, that scattering material is located at the contact point between rail and wheel.

The described exemplary embodiments shown in the figures have been selected merely by way of example. Different exemplary embodiments can be combined with one another completely or in respect of individual features. At least one exemplary embodiment can also be supplemented by features of a further exemplary embodiment. Furthermore, method steps can be repeated and also performed in a sequence other than that described. If an exemplary embodiment comprises an "and/or" link between a first feature and a second feature, this is to be read such that the exemplary embodiment comprises both the first feature and the second feature in accordance with at least one disclosed embodiment and comprises either only the first feature or only the second teacher in accordance with a further embodiment. Insofar as possible, the described approach can also be used in vehicles that are not rail-borne vehicles.

Sand can be applied to a rail of a rail vehicle by means of a sanding system. The frictional connection between the rail and a wheel of the rail vehicle can be improved by the applied sand. DE 41 22 032 A1 describes a corresponding sanding system for vehicles, in particular for rail vehicles.

LIST OF REFERENCE SIGNS

100 rail vehicle
102 first wheel
104 second wheel
106 direction of travel
108 rail
110 scattering system
112 scattering material
114 contact point
116 movement
218 wheel axle
220 storage container
222 sand valve
224 sand nozzle
226 compressed air
230 analyzing device
232 movement signal
340 sensing unit
342 analysis result
344 control unit
346 control signal
450 control method
452 analyzing method
462 reading-in step
464 evaluation step
466 adaptation step
468 provision step

The invention claimed is:

1. A method for analyzing and controlling an application of a scattering material located at a contact point between a rail and a wheel of a rail vehicle for improving a frictional connection between the rail and the wheel, the method comprising:

reading in, via an interface in an analyzing device, a movement signal representing a movement of the wheel caused by the scattering material located on the rail;

evaluating the movement signal via an the analyzing device in order to analyze the scattering material located on the rail;

controlling an application of the scattering material to the rail based on an evaluation by the analyzing device, wherein, during the evaluating, profiles of a plurality of successive deflections in a course of the movement signal are evaluated to analyze the scattering material located on the rail, and wherein the analysis comprises a determination of a quantity of the scattering material located on the rail.

2. The method of claim 1, wherein the movement signal represents a course over time of the movement of the wheel or a signal determined from the course over time of the movement of the wheel.

3. The method of claim 1, wherein the evaluating further comprises evaluation of a frequency spectrum of the movement signal to analyze the scattering material located on the rail.

4. The method of claim 1, further comprising determining a density of the scattering material at the contact point in the evaluation step based on the movement signal.

5. The method of claim 1, further comprising determining an embedding of the scattering material in a foreign layer located on the surface of the rail based on the movement signal.

6. A method for controlling an application of a scattering material to a rail for a rail vehicle, the method comprising:

reading in, via an interface in an analyzing device, a movement signal representing a movement of the wheel caused by the scattering material located on the rail and evaluating the movement signal via an the analyzing device in order to analyze the scattering material located on the rail to obtain an analysis result with regard to a scattering material located at a contact point between the rail and a wheel of the rail vehicle;

adapting an application instruction for applying the scattering material to the rail with use of the analysis result;

providing a control signal resulting in application of the scattering material to the rail in accordance with the application instruction;

wherein the analysis result comprises a determined density of the scattering material located at the contact point, and wherein, during the evaluating, profiles of a plurality of successive deflections in a course of the movement signal are evaluated to analyze the scattering material located on the rail.

7. A device for analyzing a scattering material located at a contact point between a rail and a wheel of a rail vehicle and for controlling an application of a scattering material to a rail for a rail vehicle, device comprising:

units that are configured to control the application of a scattering material to a rail for a rail vehicle by reading in a movement signal representing a movement of the wheel caused by the scattering material located on the rail and evaluating the movement signal in order to analyze the scattering material located on the rail to determine an amount of scattering material on the rail at a contact point of the wheel with the rail, wherein, during the evaluating, profiles of a plurality of successive deflections in a course of the movement signal are evaluated to analyze the scattering material located on the rail.

8. A scattering system for applying a scattering material to a rail for a rail vehicle, the system comprising:

a scattering unit for applying the scattering material to the rail; and a device that controls the application of a scattering material to a rail for a rail vehicle by reading in a movement signal representing a movement of the wheel caused by the scattering material located on the rail and evaluating the movement signal in order to analyze the scattering material located on the rail to determine an amount of scattering material on the rail at a contact point of the wheel with the rail, wherein, during the evaluating, profiles of a plurality of successive deflections in a course of the movement signal are evaluated to analyze the scattering material located on the rail.

* * * * *